United States Patent [19]

Hayashi

[11] 4,296,921

[45] Oct. 27, 1981

[54] LANCE PIPE FOR REFINING AND METHOD OF MAKING THE SAME

[75] Inventor: Yoshihiro Hayashi, Ohtsu, Japan

[73] Assignee: Aikoh Co., Ltd., Tokyo, Japan

[21] Appl. No.: 63,121

[22] Filed: Aug. 2, 1979

[30] Foreign Application Priority Data

Aug. 28, 1978 [JP] Japan ..... 53-104745
Oct. 13, 1978 [JP] Japan ..... 53-125163

[51] Int. Cl.[3] ..... C21B 7/16
[52] U.S. Cl. ..... 266/270; 75/60
[58] Field of Search ..... 266/270; 75/59, 60

[56] References Cited

U.S. PATENT DOCUMENTS 3,982,927 9/1976 Saleil ..... 75/59
4,081,270 3/1978 Tichauer ..... 75/59
4,160,664 7/1979 Maruhoshi ..... 75/59

*Primary Examiner*—P. D. Rosenberg
*Attorney, Agent, or Firm*—Fay & Sharpe

[57] ABSTRACT

A lance pipe covered with refractories having a thickness in the range 2–15 mm and a refractoriness higher than 1800° K., comprising winding the outer periphery of a pipe with a refractory fibrous thread, lace, tape or cloth having a diameter of thickness in the range 0.5–15 mm at room temperature and under normal pressure; said thread, lace, tape or cloth being impregnated and adhered with a mixture which consists of 40–90% by weight of a refractory aggregate in which most of the particle size are −10 mesh but which contains the particle size of more than 15% by weight of each of −200 mesh and 28–200 mesh, and a refractory binder as the rest which consists of one or more of silica sol including 5–40% by weight of solid parts, hydrolyzed ethyl silicate and fire clay suspension.

9 Claims, 4 Drawing Figures

LANCE PIPE FOR REFINING AND METHOD OF MAKING THE SAME

This invention relates to a lance pipe for blowing, into molten metals, oxygen, nitrogen, argon or a mixture of these gases and solid refining agents such as desulphurizing agent, deoxidizing agent and slag forming agent, and to a method for blowing said gases or said mixture into molten metals by using said lance pipe, with the intention of refining molten metals such as molten steel and pig iron.

In order to decrease wear and tear of a lance pipe consisting of steel pipe for blowing gas or a mixture of the gas and solid materials into the molten metal in a smelting furnace, ladle, pig iron mixer, tundish or forehearth, there have hitherto been developed lance pipes in which the outer periphery and inner surface of steel pipe are coated with refractories. There are so far known lance pipes such as: one in which steel pipe or steel pipe covered with anti-oxidizing materials is covered with a refractory which is mixed with metallic fibers thereby reinforcing the mechanical strength and the thermal shock resistance; one in which the inner and outer surfaces of metallic pipe are coated, in one or two layers, with each of a mixture of fire clay and brick powder and a mixture of fire clay and coke powder; one in which the tip portion of steel pipe is equipped with a protective body and the other portions of said pipe are covered with hollow, molded refractories; one in which the tip portion of steel pipe is constructed in a specific manner, and the other peripheral portions of said pipe are provided with a support post and covered with moldable refractories; one in which a stainless steel net is made a cylindrical shape, and the outer periphery of the steel pipe is embedded into covering refractories; one in which steel pipe is wound with a laminated, refractory and reinforcing material consisting of asbestos paper, aluminium foil and glass cloth; and one in which the outer periphery of a steel pipe or of a steel pipe treated with aluminium diffusion and infiltration, is wound with asbestos lace and rope and cotton rope at suitable pitch, and thereafter said outer periphery is coated with a mixture consisting of powdery or granular refractories in the range 30–200 mesh, refractory clay and alkali silicate thereby making a refractory-coated steel pipe.

However, said known technics have disadvantages that the thermal shock resistance of the layer covered with refractories is insufficient, the weight of lance pipe becomes heavy to supply said insufficiency, the coated refractories are released due to short periodic, shocking vibrations generated when blowing gases into molten steel because of short mechanical strength and resistance to slag at high temperatures whereby the effect of refractory covering is lost, and otherwise the coated refractories come off during the cooling of lance pipe after use thereby unabling the lance pipe to be used. Accordingly, in the operation of blowing gases into molten steel by using the known lance pipes there are troubles that lance pipe must be supplied or replaced on the way or new ones must be ready for supply for the following blowing. To settle these disadvantages there has been developed a lance pipe wherein a lance pipe is first treated with aluminium diffusion and infiltration, it is then wound with asbestos lace and finally it is coated with a kneaded mixture of highly refractory oxides, fire clay and an aqueous solution of water glass. In addition to the short refractoriness of asbestos and the violent gas generation at the time of use on the basis of a great amount of organic substances (adhesives) contained in the asbestos-processed product, special regard is not paid to the lowering of melting point of said highly refractory substances on the ground that the coating includes water glass, so that said disadvantages have as yet not been solved.

According to the present invention the above demerits have been eliminated. The object of the invention is to provide a lance pipe which is light and rich in thermal shock resistance, provided sufficiently with resistance to slag non-reactivity with molten metal and a refractoriness of less gases generated by the heating when in use, bearable against repeated shocking stress based on the vibrations caused when the gases are blown into molten metal, causes less wear and tear, and can be repeatedly used. Another object of the invention is to provide a method of blowing gases or a mixture of the gases and solids into molten metal by using said lance pipe, in which method operation can be conducted without supplying or replacing the lance pipe on the way.

FIG. 1 shows a lance pipe 1 of steel having a refractory tape 2 wound on the surface thereof which is impregnated with refractory material;

FIG. 2 is a cross-sectional view of FIG. 1 taken along line II—II;

FIG. 3 is similar to FIG. 1 with the exception being that refractory tape 2 is covered with a second layer of refractory material 3; and FIG. 4 is a cross-sectional view of FIG. 3, taken along line IV—IV.

Figure 1:
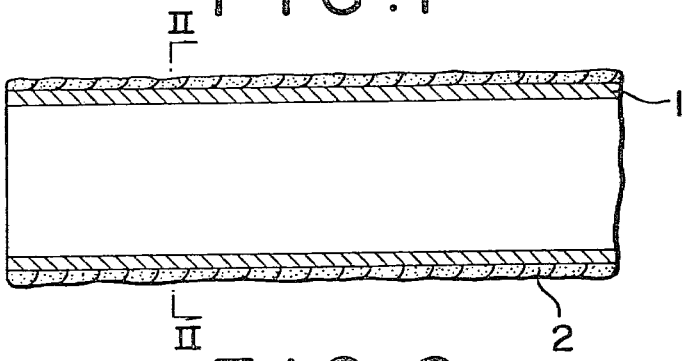
FIGS. 1–4 show lance pipe manufactured according to the teachings of the present application. Specifically.
Figure 2:
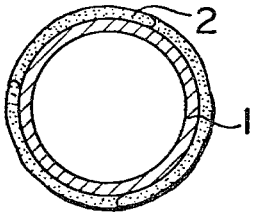
Figure 3:
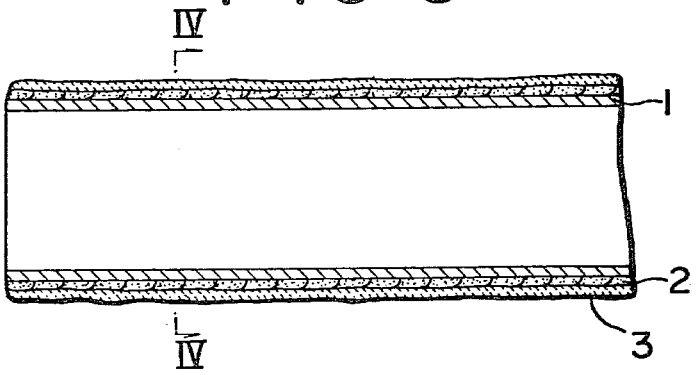
Figure 4:
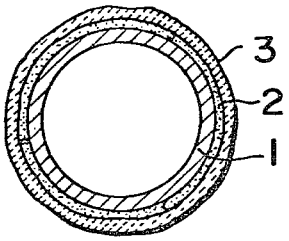

The first lance pipe of the invention is constituted in such a way that the outer periphery of the pipe is covered with refractories having a thickness in the range 2–15 mm and a refractoriness higher than 1800° K., comprising being wound with thread, lace, tape or cloth which is made of refractory fibers and has a diameter or thickness from 0.5 to 15 mm at room temperature and under normal pressure, said thread, lace, tape or cloth being impregnated and adhered with a mixture which consists of 40–90% by weight of a refractory aggregate in which most of the particle size are −10 mesh but which contains the particle size of each of −200 mesh and 28–200 mesh, by more than 15% by weight, and a refractory binder as the remainder consisting of one or more of silica sol, hydrolyzed ethyl silicate and fire clay suspension, including 5–40% by weight of solid parts.

The second lance pipe of the invention is constituted in such a way that the outer periphery of the pipe is wound in its first layer with thread, lace, tape or cloth of refractory fibers which consists of a zirconia fiber and an alumina fiber or fibrous materials including more than 45% by weight of alumina and basing on silica as the rest, said thread, lace, tape or cloth having a diameter or thickness from 0.5 to 15 mm at room temperature and under normal pressure; and said thread, lace, tape or cloth is impregnated and adhered with a mixture which consists of (a) 40–90% by weight of a refractory aggregate which is magnesia or one or more of simple oxides selected from the oxides of magnesia with alumina, yttria, chromia, zirconia, hafnia, silicon nitride and lanthanoid or a mixture with one or more selected from the composite oxides such as spinel wherein said simple oxides are added with magnesia and silica, and in which aggregate most of the particle size of the materials are −10 mesh but more than 15% by weight of the materials are contained in the particle size of each of −200 mesh and 28–200 mesh, and (b) a refractory binder as the rest consisting of one or more of water silica sol, hydrolyzed ethyl silicate and fire clay suspension, including 5–40% by weight of solid parts in terms of silica; and that said first layer is further covered with said mixture in 0.2–3 mm thickness to form a second layer and the first and second layers are heated for drying thereby providing a refractory covering having the total thickness 2 to 15 mm of the first and second layers.

The lance pipe of the invention is provided further with a refractory covering constituted in such a manner that besides said two layers, the second layer is covered as a third layer with refractories of 0.2–3 mm thickness, which consist of 30–60% by weight of one or more of natural, synthetic and industrial waste inorganic materials, including more than two of the oxides and/or fluorides of silicon, aluminium, iron, calcium, magnesium, sodium and potassium of −28 mesh; 30–60% by weight of glass fiber, slag wool or rock wool; and as the rest water silica sol, an aqueous solution of silicates of sodium and potassium or an aqueous solution of phosphates of ammonium and aluminium, including 5–40% by weight of the solid parts, the third layer being finally heated for drying.

The steel pipe used in the lance pipe of the invention is subject to infiltration and diffusion of aluminium, chrome, silicon, titanium or zirconium thereby improving the refractoriness, and the inner surface of said pipe is covered with refractories.

Further, the steel pipe can be one wherein a place near the gas blowing end is treated with an enamel covering or wherein a short pipe covered with enamel is mounted at the gas blowing end, or one which is treated with a diffusion and infiltration.

Furthermore, the pipe used in the lance pipe of the invention can be made of ceramic having a refractoriness higher than 1800° K. and a thermal shock resistance higher than 0.05 m K/S.

In addition, the invention relates to a blowing method for molten metal by using said lance pipe, in which oxygen, nitrogen and argon or a mixture of these gases and solid refining agents are blown into the molten metal.

In the lance pipe to be the first invention according to the present invention, the refractories covering the outer periphery of steel or ceramic pipe consist of thread, lace, tape or cloth made of refractory fibers, a powdery and/or granular refractory aggregate and refractory binders, said three materials being mutually active to obtain the above excellent properties. That is, the refractory aggregate compensates for the insufficient refractoriness and resistance to slag of the refractory fibers or those of the refractory fibers and binders in combination, while the refractory fibrous thread, lace, tape or cloth compensates for the insufficient thermal shock resistance and thermal insulation in the refractory aggregate and binders in combination thereby to form a tough heat-insulating layer of high refractoriness. With regard to a steel pipe it is bearable against the use for molten metals at temperatures higher than the melting temperatures thereof, and in respect of a ceramic pipe it relieves thermal shock to endure the quick immersion thereof into the molten metals.

One of the technical ideas relating to the second lance pipe of the invention is to combine the refractories constituting the first layer with said three refractory materials. Said refractory aggregate offsets the insufficient resistance to slag in the refractory fibers or those and the refractory binders in combination, while said thread, lace, tape or cloth made of the refractory fibers offsets the insufficient thermal shock resistance, mechanical shock resistance and thermal insulation thereby forming a though thermal insulating layer having high refractoriness to make the pipe bearable even against the gas blowing into molten steel bath covering the slag having temperature higher than the melting temperature of the steel pipe. In addition, the outer surface of said first layer is provided with a second thin layer which is impregnated with said refractory aggregate by said refractory binders so as to check the immersion of the molten slag into said first layer, with the help of action of the refractory fibers included in the second layer. Further, another technical ideal is to select said three highly refractory materials so that they may mix and contact each other in such manner that any molten body may not appear at the temperature of the molten steel bath. The object of said idea is to prevent the generation of susceptibility of expansion or contraction crack at the time of heating or cooling, based on the bonding other than by the refractory binders used herein i.e. the bonding powder produced by the generation of molten body. Still another technical idea is to use magnesia or one mixed necessarily with magnesia for said refractory aggregate while improving the resistance to slag. It is also one of the important technical ideas to obtain such function and effect that said second layer contacts the molten slag to be impregnated and reacted with the slag thereby solidifying the slag and forming a layer having a bonding power and that the second layer can stand the shocking vibrations based on the gas blowing from the tip of said lance pipe. Said layer impregnated with slag may sometimes come off because of the cooling after use or the raised temperature in subsequent use, but as is clear from the use conditions said impregnated zone is thin layer so that it is effective. Moreover, the technical idea of said third lance pipe i.e. of the third layer is provide good wettability of the second layer surface relative to molten slag thanks to the third layer whereby the function and effect of said second layer are more improved.

In the refractory aggregate used in the first layer of lance pipe of the invention, magnesia, or a mixture of magnesia with one or more simple oxides selected from alumina, yttria, chromia, zirconia, hafnia and the oxides of lanthanoid element, or a mixture of magnesia with one or more composite oxides including more than two of the oxides of alumina, yttria, chromia, silica, zirconia, hafnia, magnesia and the oxides of lanthanoid element, is suitable for giving resistance to slag and to prevent generation of susceptibility for expansion and contraction cracks; and the mixing ratio of magnesia in said mixtures being more than 20% by weight to achieve the object. Further, in order to make said magnesia or mixtures suitably adhesive with said refractory fibrous thread, lace, tape or cloth, it is necessary that the particle size distribution of said magnesia and mixtures is −10 mesh but more than 15% by weight of those of each of particles sizes −200 mesh and 28–200 mesh are contained. Said simple or composite oxides other than magnesia may be of different kind according to particle size. Preferably, the water silica sol selected as a refractory binder contains 5–40% by weight of solid parts in terms of silica on the basis of the containing silicon compound as $SiO_2$, and to avoid quick gelation which is caused by the mixing with magnesia, said water silica sol is or must be added, for example, with nitrogen-containing, water-soluble organic compound as a sol stabilizer.

Referring to the thread, lace, tape or cloth made of refractory fibers, its diameter or thickness in natural state is between 0.5 and 15 mm, and it consists of one or more of fibers based on alumina and silica, fibers based on alumina and silica but containing chromia as effective component, alumina fiber and zirconia fiber. Further, it may be mixed with organic fibers or metal wire to enhance its tension strength. As for the cloth, it, woven cloth or felt, may be of different kind and form for each layer if multiple layers are formed. Said alumina-silica type fibers must include more than 45% by weight of alumina in order to reach said technical idea. The refractory aggregate and water silica sol used for the second layer are the same as those used for the first layer.

The materials used for the third layer of the third lance pipe of the invention may be same as those used for the first and second layers in said second lance pipe. The materials for the third layer consist of 30–60% by weight of one or more of natural, synthetic and industrial waste inorganic materials, including more than two of the oxides and fluorides of silicon, aluminium, iron, calcium, magnesium, sodium and potassium of −28 mesh; 30–60% by weight of glass fiber, slag wool or rock wool; and an inorganic binder consisting of water silica sol, an aqueous solution of silicates of sodium and potassium or an aqueous solution of phosphates of ammonium and aluminium, including 5–40% by weight of the solids parts as the remainder. In said inorganic materials the slags to be industrial waste from blast furnace or electric furnace are suitable for use, and fly ash can also be used. Further, the water silica sol used in the third layer is identical with that used in the first or second layer. It is rapidly geletinized if said inorganic materials are ones which mix with water to form a basic aqueous solution, so that a sol stabilizer is likewise used. In such a case the sol stabilizer contacts said low-refractory inorganic materials and fibrous materials to lower the refractoriness, and therefore the object can be achieved.

In the above materials, the particle size distribution of the refractory aggregate in the first layer is essential for giving said function and effect brought about by the combination of said three materials. With the water silica sol being a transit medium, most of −200 mesh particles adhere to the single fibers constituting the thread, lace, tape or cloth made of refractory fibers, the particles in the range 28–200 mesh adhere to fill the spaces, and the remainder of them and the coarse particles form outer layer whereby the object is achieved. Similarly, the solid parts in terms of silica of the water silica sol can be contained by maximum 40% by weight thanks to the addition of said sol stabilizer. The more in content the stronger in bonding power, but more than 5% by weight of said solid parts will achieve the object in the lance pipe of the invention. The reason of making the particle size distribution of said refractory aggregate used in the second layer same as that of the first layer, is that said aggregate forms a tough, continuous layer without being separated from the first layer by including a portion which impregnated into the first layer. Furthermore, the particle size distribution of said inorganic materials used in the third layer of the third lance pipe, is to form a tough layer including the herein-used fibers in disorder arrangement, but the materials of particle size coarser than 28 mesh are not mixed because of possible fear of release after drying.

The lance pipe of the invention using the above materials is constructed in such a way that the outer periphery of a steel pipe, a steel pipe treated with a diffusion and infiltration, of aluminium, chrome, silicon and titanium, or a pipe having in its inner surface a refractory coating consisting of alumina, silica and water glass, (a) is covered as a first layer with a previously wound refractory fibrous thread, lace, tape or cloth in one or more layers, which is impregnated with and adhered by a slurry- or paste-like mixture of 40–90% by weight of a refractory aggregate and a water silica sol as the remainder; or (b) is wound in one or more layers with the refractory fibrous thread, lace, tape or cloth impregnated with and adhered by a slurry-like mixture of the refractory aggregate and water silica sol, said mixture being in the same mixing ratio as in (a) above; thereafter (c) any of the thus applied coverings is subject to natural drying and impregnated from its outer periphery with a water silica sol; or (d) is wound in one or more layers with the refractory fibrous thread, lace, tape or cloth impregnated with a slurry- or paste-like mixture consisting of a refractory aggregate of −200 mesh and a water silica sol, and then adhered a refractory aggregate of 28–200 mesh in a wet state, with the particle size distibution of said synthetized materials and the mixing ratio between the refractory aggregate and the water silica sol being in the above ranges; and that over said first layer there is formed a second layer which has a thickness from 0.2 mm to 3 mm and is impregnated and adhered with the mixture of said refractory aggregate and water silica sol, same as that used in the first layer, and finally said second layer is heated for drying for more than 0.5 hr. at temperature between 400° K. and 500° K., the total thickness of the first and second layers as a refractory covering being 2–15 mm.

Said second layer may be formed with an extra impregnating and adhering amount of said viscous, slurry-like mixture which is impregnated into the refractory fibrous lace, tape or cloth forming the final layer of said first layer.

Further, the third lance pipe of the invention is constructed in such a way that in a state before the second layer of the second lance pipe as constructed above is heated for drying, said second layer is covered with a slurry- or paste-like mixture consisting of 30–60% by weight of said inorganic materials such as blast furnace slag and the like, 30–60% by weight of said inorganic fibers such as slag wool and the like, and the remainder of said inorganic binders such as sodium silicate and the like thereby forming a third layer of a thickness in the range 0.2–3 mm; thereafter the third layer is dried for 0.5 hr. at temperatures between 400° K. and 500° K., the total thickness of the first to the third layers as a refractory covering being in the range 2–15 mm.

In said slurry- or paste-like mixture used for forming the first, second and third layers, it is superiorly effective for improving application properties and adherability of said mixture and preventing said refractory aggregate in the slurry-like mixture from depositing separation and cracking at quick drying, to add to the mixture organic materials such as cellulosic sodium glycolate (CMC), sodium polyacrylate, methyl cellulose, polyvinyl alcohol, polyethylene oxide, starch, dextrin, casein and gum arabic, thanks to the various actions such as viscosity promotion, dispersion and bonding possessed by them. Suitably 0.3-5 parts by weight of said organic materials are added to 100 parts by weight of the water silica sol.

EXAMPLE 1

The outer periphery of a steel pipe (JIS G STK41) of 21.2 mm outside diameter, 2.5 mm thickness and 5.5 m length, which pipe being treated with diffusion and infiltration of aluminium in 0.3 mm, was wound in three layers in reverse direction (clockwise, anticlockwise) for each layer under a tension of about 20 kPa with a refractory fibrous lace, leaving 120 mm blank at one end of the pipe, said lace being reinforced with synthetic chemical fibers, basing on about 60% by weight of alumina and about 40% by weight of silica and having 4 mm diameter at room temperature and under normal pressure, and further said lace being impregnated and adhered with a slurry-like mixture of 6 parts by weight of a refractory aggregate consisting of 30% by weight of magnesia and spinel as the remainder, and one part by weight of a sol-stabilized aqueous silica sol including 25% by weight of solid parts when red heated; thereby to form a first layer. Then the first layer was impregnated and adhered in 1 mm thickness with a paste-like mixture consisting of 8 parts by weight of a refractory aggregate comprising 70% by weight of magnesia and 30% by weight of spinel, one part by weight of the aqueous silica sol same as that used in the first layer, and one part by weight of aqueous solution comprising 5% by weight of cellulosic sodium glycolate thereby to form a second layer, while forming a refractory covering of 8 mm thickness.

The particle size distribution of magnesia and spinel used in the first layer is such that 20 parts by weight are of 20-28 mesh, 20 parts by weight of 28-100 mesh,25 parts by weight of 100-200 mesh, 30 parts by weight of −200 mesh, and the remainder of 10-20 mesh; and that of the same materials in the second layer is such that 25 parts by weight are of 28-48 mesh, 35 parts by weight of 48-100 mesh, and the remainder of 100-200 mesh. Moreover, each lamina constituting the first layer in the three layer type lance pipe was fed with wind for forced drying for 10 min.

A lance pipe which was heated for drying for 0.5 hr. at 500° K. in only the final manufacturing procedure was used, under the conditions of 20 $Nm^3$/min. of oxygen flow and 10 min. of blowing time, for the oxygen blowing in a 30 ton electric arc furnace which melt produces JIS G SKS4 (composition: C 0.45-0.55, Si<0.35, Mn<0.50, P<0.030, Cr 0.50-1.00, W 0.5-1.00 and the rest Fe). The average wearing and tearing rate of said lance pipe was so slow as 1.2 m wear per oxygen blowing, and therefore the replacement of lance pipe became to require shorter period of time whereby good blowing operation could be carried out.

EXAMPLE 2

The outer periphery of a steel pipe same as in Example 1 was would in three laminae with the same refractory fibrous lace under a tension of about 10 kPa, leaving 120 mm blank at one end of the pipe, said lace being pregnated with a slurry-like mixture of 5 parts by weight of −200 mesh magnesia and zircon fluor ($ZrSiO_4$ of −325 mesh) and the water silica sol same as that used in Example 1; said laminae were immediately sprinkled for adhesion with a mixture of 65 mesh magnesia and zircon sand; and they were forcedly dried under fed wind for 10 min. thereby to form a first layer. Said first layer was covered with a second layer of 1 mm thickness by using the mixing materials same as those used in Example 1. Further, said second layer was covered with a third layer of 1 mm thickness, said third layer being formed by a paste-like mixture with an aqueous solution including 70% by weight of inferior silica sand, 15% by weight of slag wool, and remaining 20% by weight of sodium silicate and 5% by weight of cellulosic sodium glycolate; said silica sand containing about 90% by weight of silica in a particle size distribution wherein particles of each of 28 mesh, 65 mesh and 150 mesh are included approximately in same quantity, and containing the main components of impurities as alumina and iron oxide; thereby to form a refractory covering of 12 mm thickness. The mixing ratio of magnesia in the mixture between magnesia and zircon in the first and second layers is 50% by weight.

A thus-made lance pipe which was dried under heating for 0.5 hr. at 500° K. in its final procedure only, was used, under the conditions of 25 $Nm^3$/min. of oxygen flow and 15 min. of blowing time, for the oxygen blowing in a 30 ton electric arc furnace which melt produces SUS304 (stainless steel of Ni 8.0-10.5 and Cr 18.0-20.0), when there were obtained the wearing rate and blowing operation conditions of said lance pipe, same as those in Example 1.

EXAMPLE 3

A lance pipe having a refractory covering of 15 mm thickness was prepared in such a manner that a steel pipe of 34.0 mm outside diameter, 3.2 mm thickness and 2.7 m length was wound, in the first and second layers, with a refractory fibrous lace by using the materials and method same as those used in Example 2, leaving 200 mm blank at one end of the pipe, said lace being reinforced with stainless steel wire, basing on 50% by weight of each of alumina and silica and having 4 mm diameter at room temperature and under normal pressure; then said first and second layers were dried by heating for 1 hr. at 500° K.

The lance pipe thus prepared was immersed by 2 m for 15 min. into a molten pig iron bath at 1650°-1750° K. in a 100 ton ladle, to use it for desulphurizing operation of blowing calcium carbide by nitrogen, when it could be used 30 times. Referring to the use method, it became easy to mount the lance pipe to ladle because of its light weight whereby the working cost could be decreased.

EXAMPLE 4

The outer periphery of a structural carbon steel pipe, which was treated with a diffusion and infiltration of 0.3 mm thick aluminium at its inner and outer surfaces and which has 21.2 mm outside diameter, 2.3 mm thickness and 5.5 m length, was closely wound with a refractory fibrous lace in a single lamina under a tension of about 10 kPa, leaving 200 mm blank at one end of the pipe, said lace being reinforced with synthetic chemical fibers, basing on 50% by weight of each of alumina and silica and having 4 mm diameter at room temperature and under normal pressure. The outer surface of said pipe wherein the layer of the refractory fibers is now about 3.5 mm thickness, was coated with a paste-like mixture in which 40 parts of water were added to 30 parts of fire clay, 30 parts of sintered alumina of 28 mesh particle size and 40 parts of said alumina of 48 mesh one, and they were kneaded for mixing, in such a way that said outer surface became smooth, thereby providing a 4 mm thickness of the whole refractory covering. Said covering was subject to natural drying and impregnated with silica sol of 10% by weight solid parts. Only in the final process said pipe was dried by heating for 0.5 hr. and at 500° K. In this lance pipe the increased weight is 2.4 Kg to the weight 6.1 Kg of the steel pipe in blank. This lance pipe was used under the conditions of 20 $Nm^3$/min. of oxygen flow and 10 min. of blowing time, for the oxygen blowing in a 30 ton electric arc furnace which melt produces alloy tool steels. The average wearing and tearing rate of said lance pipe was so slow as 0.2 m/min. It was sound despite its exposure to the atmosphere and radiant heat higher than 1850° K. and could be successively used for subsequent oxygen blowings. The state after use wherein the end of the steel pipe was worn by 40 mm but leaving the tubular refractory layer, proves said slight rate of average wear. In addition said increased weight did not disturb the working.

EXAMPLE 5

The outer periphery of a steel pipe same as that used in Example 4 except that only the inner surface was treated with a diffusion osmosis of 0.3 mm aluminium thickness, was closely wound with a refractory fibrous lace under a tension of about 20 kPa, leaving a 200 mm blank at one end of the pipe; said lace being reinforced with steel wire, basing on about 60% alumina and about 40% silica and having 3 mm diameter at room temperature and under normal pressure. Before winding, however, said lace was immersed into a bath where there were mixed and kneaded, with slurry, one part by weight of hydrolyzed ethyl silicate of 30% by weight solid parts, 0.5 parts by weight of alumina sol and 3 parts by weight of fine powdery alumina of −325 mesh. After the winding of the lace, alumina grains in the range 48 to 65 mesh were immediately sprinkled onto the lace and said lace was subject to natural drying thereby to provide a first layer. Then a second layer was provided under the same procedures but with the sprinkled alumina particles of 48–65 mesh, the second layer was coated with said slurry, and after natural drying it was further dried by heating at 500° K. thereby providing a lance pipe having a refractory covering of 6 mm thickness. The lance pipe which increased its weight by 4.2 Kg was used, under the conditions of 25 $Nm^3$/min. and 15 min. of blowing time, for the oxygen blowing in a 30 ton arc furnace which melt produces stainless steel as in said Example 2, when there could be obtained the results and observation conditions same as those in Example 4.

EXAMPLE 6

Firstly the inner and outer surfaces of the steel pipe (of 1.8 m length) same as that used in Example 4 were applied, in a 150 mm range at one end, with 1 mm thick enameled film with a mixture which bases on pulverized sheet glass, cryolite and feldspar, is added with a thickening agent and has a melting point of about 1250° K. The steel pipe was wound with a refractory fibrous lace, leaving 200 mm of the other end, thereby to form a first layer; said lace being reinforced with synthetic organic fibers, basing on 50% by weight of each of alumina and silica and having 2 mm diameter. Said first layer was closely wound then with a 1 mm diameter thread of silicon carbide fiber thereby to form a second layer; said thread being impregnated and adhered with a paste-like mixture of silica sol of 30% by weight solid parts when red heated, chamotte of such a particle size distribution as 30% by weight of −200 mesh, 40% by weight of 65–100 mesh and the rest of 28–65 mesh, and silicon carbide of the same particle size distribution. The first and second layers were dried by heating at 500° K. thereby providing a lance pipe having a refractory covering of 3 mm thickness.

The lance pipe thus prepared was used for blowing a gas mixture comprising 30% by volume of chlorine and 70% by volume of nitrogen into molten aluminium of 900° K. in a forehearth, at the flow rate 60 l/min. for 2 hr. (pouring rate 75 Kg/min. and the total pouring weight 9 ton). Observation after cooling the lance pipe did not reveal a melting down even at the tip portion (enamel treatment portion) of a steel pipe, and the lance pipe could be used again.

EXAMPLE 7

Into the hollow portion of a chamotte ceramic pipe was inserted a steel pipe having 21.2 mm outside diameter, 2.3 mm thickness and 2.7 m length, when the two pipes were partially adhered with alumina cement. Six ceramic pipes of this kind were connected to form one having 32 mm outside diameter, 4.5 mm thickness and 400 mm length. The whole outer circumference of said chamotte ceramic pipe was closely wound with a lace made of silicon carbide fiber and having 1 mm diameter, under a tension of about 15 kPa. Before winding, however, said lace was immersed into a bath where there were mixed, with slurry, one part by weight of a silica sol solution of 15% by weight in terms of silica, and 3.5 parts by weight of spinel consisting of fine powders of magnesia, alumina and chrome oxide of −325 mesh. After the winding of the lace, said spinel grains of −48 mesh were immediately sprinkled onto the lace. This operation was repeated to make five layers. After the drying of said five layers they were infiltrated with the slurry and again dried by heating at 500° K.

The lance pipe thus made was used for the desulphurizing operation under the condition of blowing calcium carbide for 15 min. with nitrogen gas, by immersing said pipe by 1.2 m into molten pig iron at temperatures between 1650° and 1750° K. in a pig iron mixer. The lance pipe could be used for this operation more than 20 times.

What is claimed is:

1. A method of producing a heat-resistant lance pipe which comprises:

(a) providing a hollow refractory tube, and (b) applying to at least part of the outer surface thereof a first layer of an impregnated fibrous refractory material, with said fiber being based on alumina or silica and having a diameter ranging from 0.5 to 15.0 mm, said fibers being impregnated with a mixture consisting of 40–90% by weight of a refractory aggregate having a particle size of less than −10 mesh which contains in excess of 15% by weight of particles having a particle size of −200 mesh and in excess of 15% by weight of particles having a particle size of 28–200 mesh, and from 10–50% by weight of a refractory binder which includes at least one material from the group consisting of silica sol including 5–40% by weight of solid parts, hydrolyzed ethyl silicate and fire clay suspension.

2. The method of claim 1 which further comprises the step of adhering to the surface of said first layer of impregnated refractory material a second layer of refractory material of the same composition as used to impregnate said first layer of fibrous material, with said second layer having a thickness of 0.2–3 mm and being applied in such a manner that the total thickness of said first and second layer is between 2 and 15 mm.

3. The method of claim 2 which further comprises the step of applying a third layer of material over said second layer, which third layer consists of 30–60% by weight of at least one material selected from the group consisting of natural, synthetic and industrial waste inorganic materials, including more than two of the oxides and fluorides of silicon, aluminum, iron, calcium, magnesium, sodium and potassium, 30–60% by weight of glass fiber, slag wool or rock wool, with the remainder being a binder selected from the group consisting of an aqueous silica sol including 5–45% by weight of the solid parts, an aqueous solution of silicates of sodium and potassium, or an aqueous solution of phosphates of ammonium and aluminium.

4. The method of claim 1 wherein said refractory aggregate is at least one material selected from the group consisting of alumina, silica, titania, zirconia, silicon carbide, boron carbide, silicon nitride, boron nitride, or an oxide of alumina, silica, magnesia, chromia, yttria, calcia, lithia, titania, zirconia, hafnia and oxides of lanthanoid elements, or a natural or synthetic cyrstalline or amorphous materials which contain the composite oxides of said oxides as principal components; with said refractory aggregate having a particle size of less than −10 mesh, but containing more than 15% by weight of each of −200 mesh and 48–200 mesh particles.

5. The method of claim 1 wherein said tube is fabricated from steel.

6. The method of claim 5 wherein the tube is treated with a diffusion and infiltration of at least one material selected from the group consisting of alumina, chrome, silicon, titanium, and zirconium.

7. The method of claim 5 which further comprises the step of providing the inner surface of said tube with a refractory coating.

8. A lance pipe for blowing materials into molten metal which is produced by the method described in claim 1.

9. A lance pipe which comprises a hollow refractory tube having on the outer surface thereof a fibrous refractory material consisting of alumina or silica base fibers and having a diameter ranging from 0.5 to 15.0 mm, said fibers being impregnated with a refractory material consisting of 40–90% by weight of a refractory aggregate having a particle size of less than −10 mesh which contains in excess of 15% by weight of particles having a particle size of 28–200 mesh and 15% by weight of particles having a particle size of −200 mesh, and from 10–50% by weight of a refractory binder which includes at least one material selected from the group consisting of silica sol including 5–40% by weight of solid parts, hydrolyzed ethyl silicate and fire clay suspension.

* * * * *